US010351321B1

(12) United States Patent
Wallwey et al.

(10) Patent No.: US 10,351,321 B1
(45) Date of Patent: Jul. 16, 2019

(54) SCOOP HOLDER

(71) Applicants: Dean W. Wallwey, Aurora, CO (US); Marjorie A. Wallwey, Auroroa, CO (US); Blake St. Clair, Littleton, CO (US)

(72) Inventors: Dean W. Wallwey, Aurora, CO (US); Marjorie A. Wallwey, Auroroa, CO (US); Blake St. Clair, Littleton, CO (US)

( * ) Notice: Subject to any disclaimer, the term of this patent is extended or adjusted under 35 U.S.C. 154(b) by 0 days.

(21) Appl. No.: 15/906,766

(22) Filed: Feb. 27, 2018

Related U.S. Application Data

(63) Continuation of application No. 29/638,250, filed on Feb. 26, 2018, now Pat. No. Des. 849,537.

(51) Int. Cl.
*B65D 1/24* (2006.01)
*B65D 51/24* (2006.01)

(52) U.S. Cl.
CPC ..... *B65D 51/246* (2013.01)

(58) Field of Classification Search
CPC combination set(s) only.
See application file for complete search history.

(56) References Cited

U.S. PATENT DOCUMENTS 5,236,022 A 8/1993 Husted
5,482,095 A * 1/1996 de Chollet ..... B65D 23/12 141/18
5,706,974 A * 1/1998 Murdick ..... B65D 51/246 206/230
7,040,500 B2 * 5/2006 Kipperman ..... A61J 9/00 206/553
7,971,747 B2 * 7/2011 Blomdahl ..... B65D 51/247 220/212
8,042,704 B2 10/2011 Borowski
8,376,179 B2 * 2/2013 Horton ..... B65D 21/0222 220/735
8,469,223 B2 * 6/2013 Perry ..... B65D 1/42 220/212
8,627,981 B2 * 1/2014 Perry ..... B65D 25/2897 206/553
8,651,311 B1 2/2014 Drummond
9,090,391 B2 7/2015 Horton
9,387,963 B2 * 7/2016 McBroom ..... B65D 43/169
9,493,271 B2 11/2016 Gillie
9,538,871 B2 * 1/2017 Renkola ..... A47G 21/145
9,541,441 B2 1/2017 Prero
9,669,964 B2 * 6/2017 Vogel ..... B65D 23/12
(Continued)

FOREIGN PATENT DOCUMENTS

CN 204776498 11/2015
DE 202013104331 12/2013
(Continued)

*Primary Examiner* — Monica E Millner
(74) *Attorney, Agent, or Firm* — Leyendecker & Lemire, LLC

(57) ABSTRACT

A scoop holder is described. Embodiments of the scoop holder can be implemented to secure to either a handle or a bowl of a scoop. The scoop holder can typically be coupled to an interior of a lid of a container and secure a scoop thereto. The scoop holder can be defined by a first curved surface, a second curved surface opposing the first curved surface, and a hollow cylinder including a slot bisecting a wall of the hollow cylinder.

20 Claims, 12 Drawing Sheets

(56) References Cited

U.S. PATENT DOCUMENTS

| | | | | |
|---|---|---|---|---|
| 9,930,996 | B2 * | 4/2018 | Wiggins | A47J 47/06 |
| 10,029,821 | B2 * | 7/2018 | Haverland | B65D 23/12 |
| 10,239,675 | B2 * | 3/2019 | Choi | B65D 51/246 |
| 2002/0190112 | A1 * | 12/2002 | Culeron | B65D 5/42 229/145 |
| 2006/0156811 | A1 * | 7/2006 | Borowski | A47J 47/01 73/426 |
| 2007/0102061 | A1 * | 5/2007 | Tsao | B65D 77/245 141/380 |
| 2008/0156808 | A1 * | 7/2008 | Perry | B65D 25/2897 220/560.03 |
| 2010/0308065 | A1 * | 12/2010 | Vandamme | B65D 43/169 220/697 |
| 2010/0326848 | A1 | 12/2010 | Mangin | |
| 2012/0000925 | A1 | 1/2012 | Dols | |
| 2013/0081364 | A1 | 4/2013 | Piscopo | |
| 2014/0131355 | A1 * | 5/2014 | Jentis | B65D 43/169 220/212 |
| 2014/0299598 | A1 | 10/2014 | Irani | |
| 2015/0197381 | A1 | 7/2015 | Valenti | |
| 2016/0318676 | A1 | 11/2016 | Choi | |
| 2017/0096268 | A1 | 4/2017 | Perry | |
| 2017/0203890 | A1 | 7/2017 | Lenz | |
| 2017/0210507 | A1 | 7/2017 | Rule | |
| 2017/0297804 | A1 | 10/2017 | Love | |

FOREIGN PATENT DOCUMENTS

| | | |
|---|---|---|
| EP | 3253678 | 12/2017 |
| EP | 3261946 | 1/2018 |
| ES | 2597968 | 1/2017 |
| FR | 2747107 | 10/1997 |
| JP | 2001104173 | 4/2001 |
| JP | 2006089048 | 4/2006 |
| JP | 2014091528 | 5/2014 |
| KR | 1020030072440 | 9/2003 |
| KR | 100981494 | 9/2010 |
| WO | 201613831 | 9/2016 |
| WO | 2017096191 | 6/2017 |

* cited by examiner

SCOOP HOLDER

CROSS-REFERENCE TO RELATED APPLICATION

This application is a continuation of U.S. Design patent application Ser. No. 29/638,250 filed Feb. 26, 2018 and having the same inventorship. U.S. Design patent application Ser. No. 29/638,250 filed Feb. 26, 2018 is hereby incorporated in its entirety.

BACKGROUND

Containers designed to house powders and other finite sized particulates often require the use of a scoop to remove the contents from said container. Currently, most scoops are stored in an interior of the container, often initially resting on top of the contents of the container, requiring a user to place their hand inside the container to retrieve the scoop. Over time and often during transport, these scoops sink into the container contents and must be dug out by a user. Alternatively, many different scoop holders are designed as being integral to the container or to a lid of the container limiting the scoop holder to just that container.

DETAILED DESCRIPTION

Figure 1:
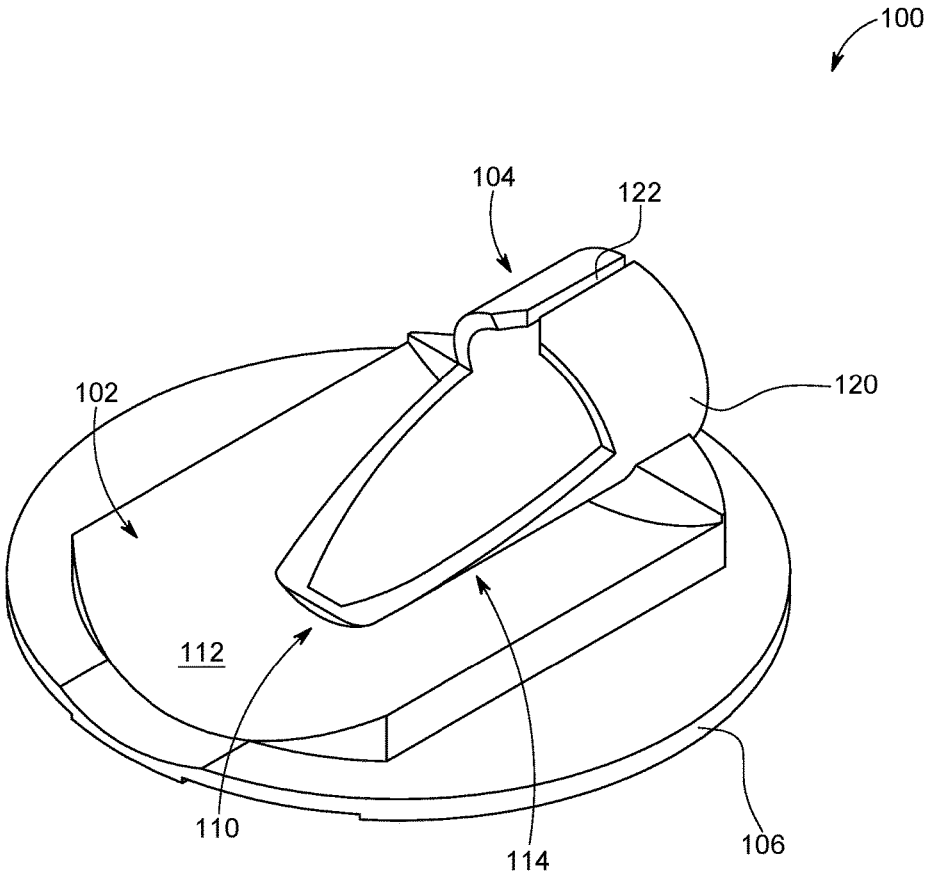
FIG. 1 is a perspective view of a scoop holder according to one embodiment of the present invention.

Embodiments of the present invention include a scoop holder configured to receive and secure a handle or a bowl of a scoop. The scoop holder can be implemented to couple a scoop to a surface or substrate. For instance, the scoop holder can couple to an interior side of a lid of a container. Typically, the scoop holder can include, but is not limited to, a first slot, a second slot, and a base. The first slot and the second slot can be coupled to the base. In one embodiment, the second slot can be coupled to the first slot, where the first slot can be coupled to the base. In some embodiments, the scoop holder can be manufactured from a single piece of material. In other embodiments, the base, the first slot, and the second slot can be individually formed and then coupled together. In yet other embodiments, the first slot and the second slot can be integrally formed together and coupled to the base.

Typically, the first slot can be configured to receive a bowl of a scoop and the second slot can be configured to receive a handle of a scoop.

In one embodiment, the first slot can be defined by a first surface and a second surface. The first surface can be configured to interface with an exterior of the scoop bowl and the second surface can be configured to interface with an interior of the scoop bowl. The first surface can be defined by a substantially concave shape having a first radius. The second surface can be defined by a substantially convex shape having a second radius.

In one embodiment, a longitudinal axis of the first surface relative to a longitudinal axis of the second surface can be oriented at an acute angle. For example, the acute angle can be approximately 5-15 degrees. In another embodiment, the longitudinal axis of the first surface can be substantially parallel to the longitudinal axis of the second surface. As can be appreciated, by angling the second surface relative to the first surface, the first slot can pinch or compress the bowl of the scoop thus securing the bowl in place between the first surface and the second surface.

In one embodiment, the scoop holder can include a base, a bowl slot, and a cylindrical ring. The bowl slot can comprise top and bottom curved surfaces configured to receive the bowl of the scoop. A radius of curvature of the opposing surfaces can be differing. A cylindrical ring can extend orthogonally outwardly of a base of the holder. The cylindrical ring can be split at an apex of the cylindrical ring (i.e., the greatest distance from the base). Accordingly, a handle can be received through the slot and through the cylindrical ring. Of important note, the backside of the base can be substantially flat permitting the scoop holder to be attached to any suitable flat surface with a suitable adhesive. In one variation, the scoop holder can be attached to an inside of a lid of a container. In other variations, the scoop holder can be attached to an inside of a kitchen cabinet or the outside of a lid or a container.

In one embodiment, the scoop holder can include a base, a first protrusion, and a second protrusion. The first protrusion can extend upwardly from the base and can be defined by a substantially curved upper surface being concave. The second protrusion can extend upwardly from the base and above the first protrusion. The second protrusion can be defined by a first portion and a second portion. The first portion can have a curved bottom surface that can oppose the first protrusion. The second portion can be a hollow cylinder including a slot that bisects a wall of the hollow cylinder.

In another embodiment, the scoop holder can include a first engagement member, a second engagement member, and a base. The first engagement member can be adapted to secure a bowl of a scoop and can be defined by a first curved surface being substantially concave and a second curved surface opposing the first curved surface. The second curved surface can be substantially convex. The first curved surface and the second curved surface can form a first slot. The second engagement member can be adapted to secure to a handle of a scoop and can be defined by a cylindrical ring having a second slot that bisects a wall of the cylindrical ring. The base can be coupled to the first engagement member and the second engagement member.

In yet another embodiment, the scoop holder can include a first slot and a second slot. The first slot can be adapted to receive a bowl of a scoop. The first slot can include a first curved surface and a second curved surface. The first curved surface can be concave and defined by a first radius of curvature. The second curved surface can be convex, located above and opposing the first curved surface, and defined by a second radius of curvature. The first radius of curvature can be larger than the second radius of curvature. The second slot can be adapted to receive a handle of the scoop. The second slot can bisect a wall of a hollow cylinder where the first slot can be coupled to the hollow cylinder.

In one embodiment, the previously described embodiments of the scoop holder can be integrally formed as part of a container. In another embodiment, the previously described scoop holder can be integrally formed as part of a lid for a container. In such an embodiment, the lid may be considered the base of the scoop holder and the first engagement member and the second engagement member may extend out from the lid or container. In yet another embodiment, the scoop holder may be co-molded into a lid of a container or the container itself.

In one embodiment, the scoop holder can be located proximate a center of a bottom side of a container lid. Of note, with the scoop holder be placed proximate the center of the lid, when holding the scoop by the bowl, the scoop holder can center the scoop handle as a central pivot point with the benefit of the least surface area dragging in the powdered contents. Stated alternatively, when the handle extends down into contents of the container, by having the scoop centered, the handle can rotate in a middle of the contents minimizing the amount of contact between the scoop handle and the contents of the container.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

A First Embodiment of a Scoop Holder

Referring generally to FIGS. 1-7, detailed diagrams of a first embodiment 100 of a scoop holder are illustrated. In one instance, the scoop holder 100 can be implemented to secure a scoop to an underside of a lid of a container. As can be appreciated, the scoop holder 100 can effectively secure the scoop to an interior of the container. Typically, the scoop holder 100 can removably couple to either a bowl or a handle of a scoop.

Referring to FIG. 1, a perspective view of the scoop holder 100 is illustrated. Typically, the scoop holder 100 can include, but is not limited to, a first engagement member 102, a second engagement member 104, and a base 106. The first engagement member 102 can be implemented to receive and secure a bowl of a scoop. The second engagement member 104 can be implemented to receive and secure to a handle of a scoop. The base 106 can be implemented to provide a surface for coupling to another surface. Typically, the first engagement member 102 can form a first slot and the second engagement member can form a second slot, each described hereinafter.

In one embodiment, the first engagement member 102, the second engagement member 104, and the base 106 can be integrally formed together. For instance, the scoop holder 100 can be manufactured from a single block of material. In another instance, the scoop holder 100 may be manufactured by a 3D printing process. In yet another instance, the scoop holder 100 may be manufactured by an injection molding process. In some alternative embodiments, the components 102-106 can be individually manufactured and then coupled together. In yet other embodiments, two or more components may be integrally formed together with a third component individually manufactured and coupled to the integrally formed components. For example, the base 106 and the first engagement member 102 may be integrally formed together and the second engagement member 104 can be coupled to the base 106. As will be described hereinafter, a portion of the first engagement member 102 (i.e., a second curved surface 114) may be integrally formed with the second engagement member 104.

Figure 2:
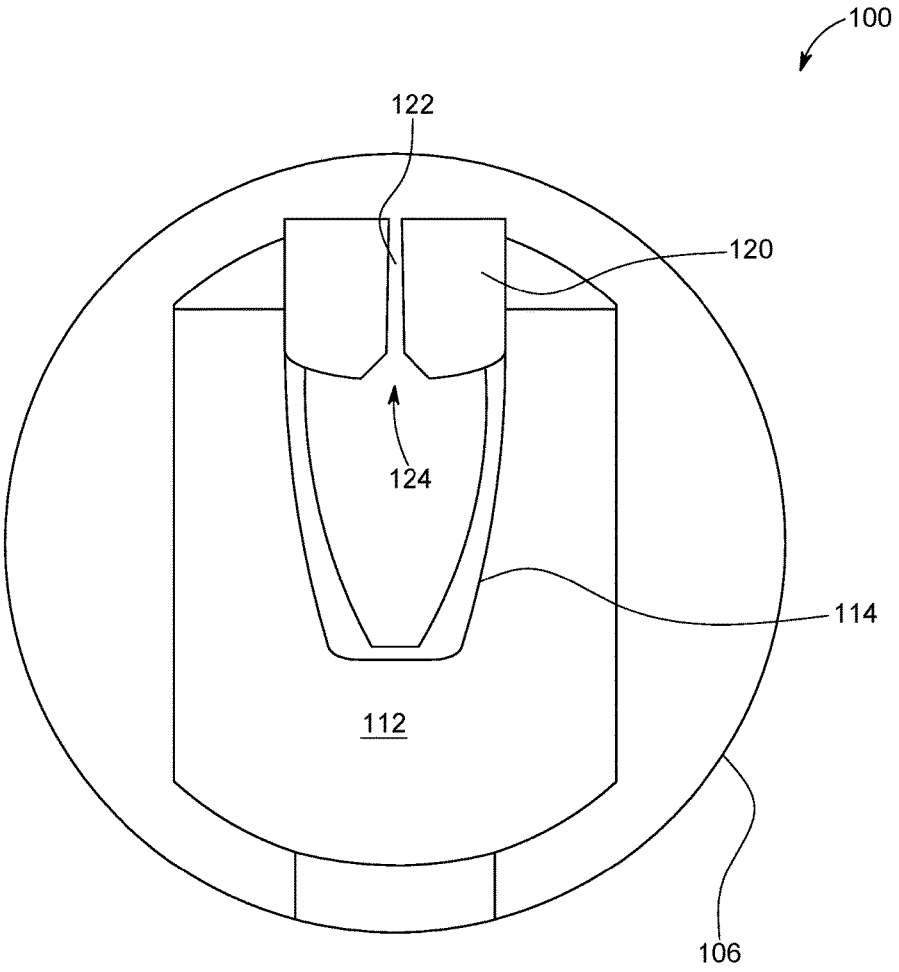
FIG. 2 is a top view of a scoop holder according to one embodiment of the present invention.
Figure 6:
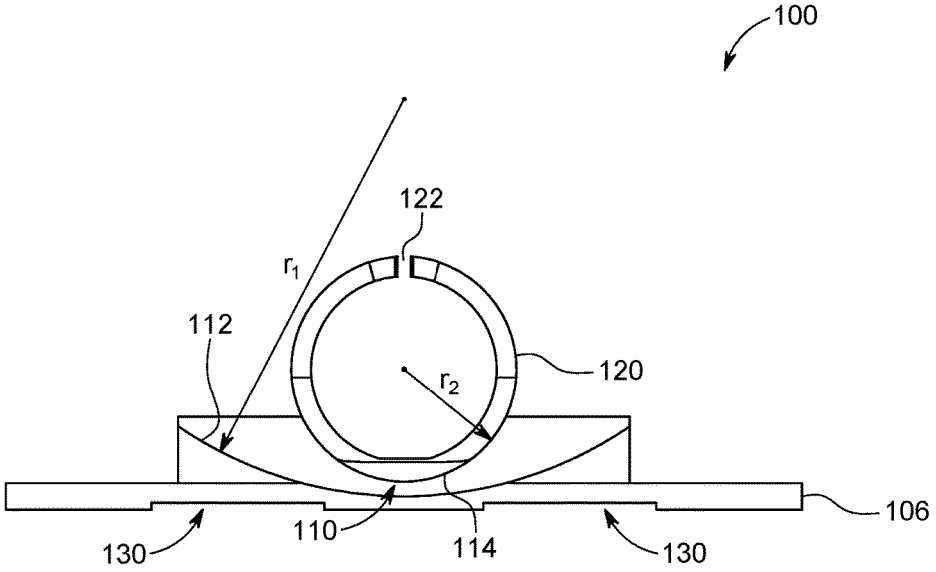
FIG. 6 is a front view of a scoop holder according to one embodiment of the present invention.

As shown generally in FIGS. 1-2 and 6, the first engagement member 102 can form a first slot 110 configured to receive the bowl of a scoop. The first slot 110 can be defined by a first curved surface 112 and a second curved surface 114. The first curved surface 112 can be concave and can be defined by a first radius of curvature. The second curved surface 114 can be substantially convex and can be defined by a second radius of curvature. Generally, the first radius of curvature can be larger than the second radius of curvature. In a typical embodiment, the first radius of curvature can be approximately three times the size of the second radius of curvature.

As shown in FIGS. 1 and 6, the second curved surface 114 can be located above and oppose the first curved surface 112. In one instance, a longitudinal axis of a circle formed by the first radius of curvature can be parallel with a longitudinal axis of a circle formed by the second radius of curvature. As mentioned previously, the longitudinal axis of the circle formed by the second radius of curvature would be located above and parallel with the circled formed by the first radius of curvature. Typically, the second curved surface 114 can be located a predetermined distance above the first curved surface 112. As can be appreciated, the predetermined distance can be varied to allow the bowl of a scoop to be received snugly between the curved surfaces 112, 114. Depending on an implementation, the predetermined distance can be fixed or in some instances, the distance between the first curved surface and the second curved surface can be adjustable.

In one embodiment, the second engagement member 104 can include a hollow cylinder 120 with a second slot 122 formed therein. The second slot 122 can be configured to receive the handle of a scoop. Typically, the second slot 122 can bisect a wall of the hollow cylinder 120. As shown in FIG. 2, the second slot 122 can include a mouth 124 to guide a handle of a scoop into the second slot 122. In a typical implementation, a handle of a scoop can be passed into the second slot 122 with a stiffening rib located under the handle of the scoop passing to an inside of the hollow cylinder 120.

In some embodiments, the second curved surface 114 of the first engagement member 102 can be formed from a portion of the hollow cylinder 120. For instance, an exterior of the hollow cylinder 120 can form the second curved surface 114. In such an embodiment, the hollow cylinder 120 can extend along a length of the first curved surface 112 and can include a cut away forming the second curved surface 114 of the first engagement member 102. Alternatively, the second curved surface 114 can be defined as a minor segment formed from a chord of a circle formed by the hollow cylinder 120.

Referring to FIG. 6, a front view of the scoop holder 100 is illustrated. As shown in FIG. 6, the first curved surface 112 can be defined by a first radius of curvature "$r_1$" and the second curved surface 114 can be defined by a second radius of curvature "$r_2$". Typically, the first radius of curvature $r_1$ can be larger than the second radius of curvature $r_2$. In one embodiment, the first radius of curvature $r_1$ can be approximately three times the size of the second radius of curvature $r_2$. A center point of a circle formed by the first radius of curvature $r_1$ can be located above and in line with a center point of a circle formed by the second radius of curvature $r_2$. As can be appreciated, in most implementations, the circle formed by the first radius of curvature $r_1$ will not be concentric with the circle formed by the second radius of curvature $r_2$.

Figure 3:
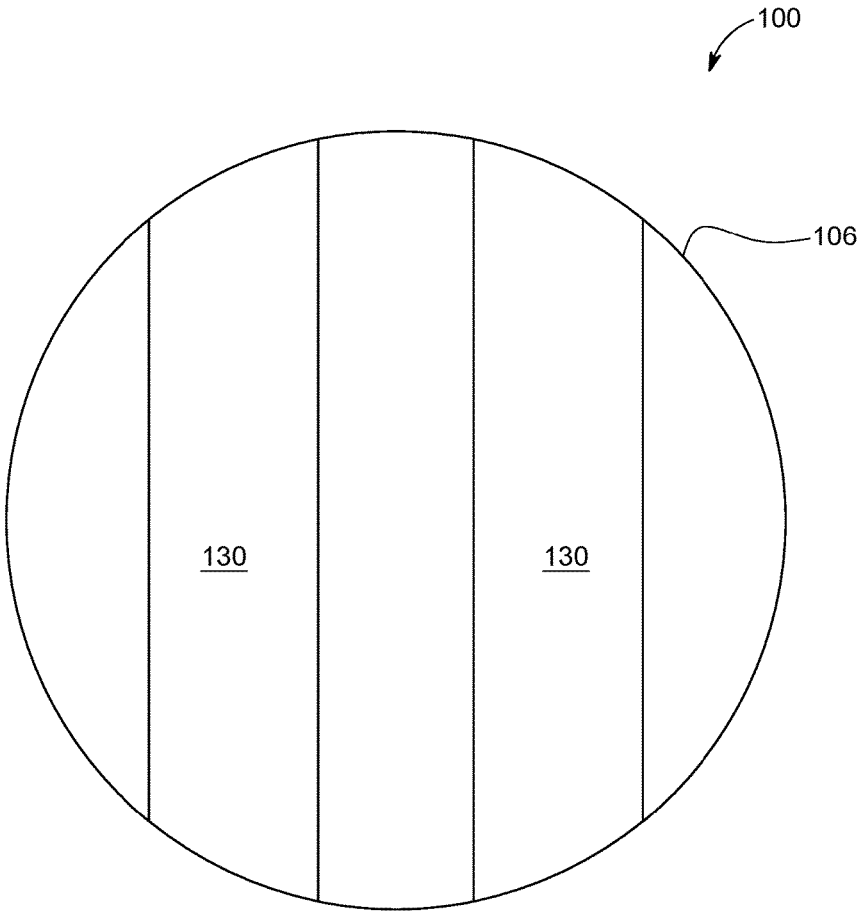
FIG. 3 is a bottom view of a scoop holder according to one embodiment of the present invention.

Referring to FIG. 3, a bottom of the scoop holder 100 is illustrated. In one embodiment, as shown, the base 106 can include a pair of recesses 130 having a substantially rectangular shape in the bottom of the base 106. Typically, an adhesive can be placed along a length of each of the recesses 130 to allow the base 106 to couple to and sit flush against a surface. Of note, the recesses 130 are shown with a substantially rectangular shape, however, other configurations and shapes could be implemented for the recesses 130. For example, a ring-shaped recess could be implemented. In other embodiments, the bottom of the base 106 may be flat with no recesses and an adhesive can be placed on the flat surface of the base 106.

Figure 4:
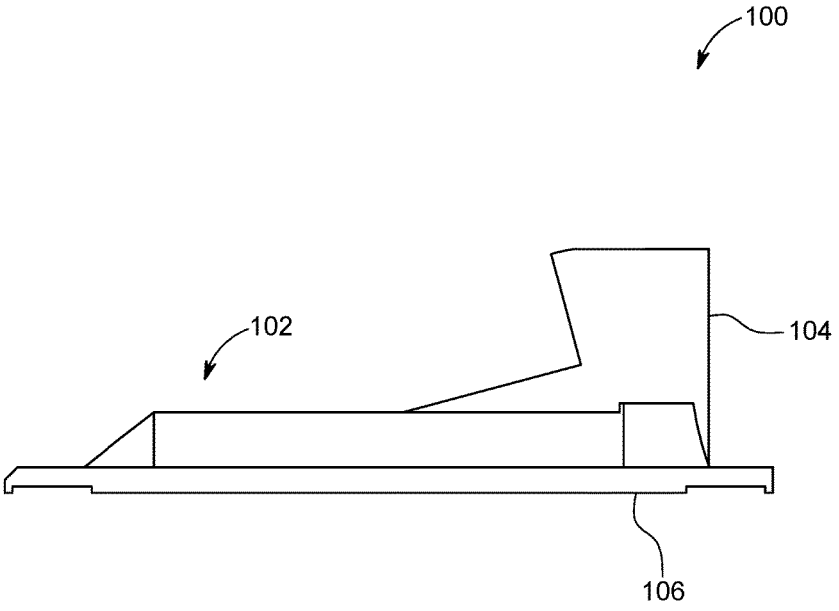
FIG. 4 is a right-side view of a scoop holder according to one embodiment of the present invention.
Figure 5:
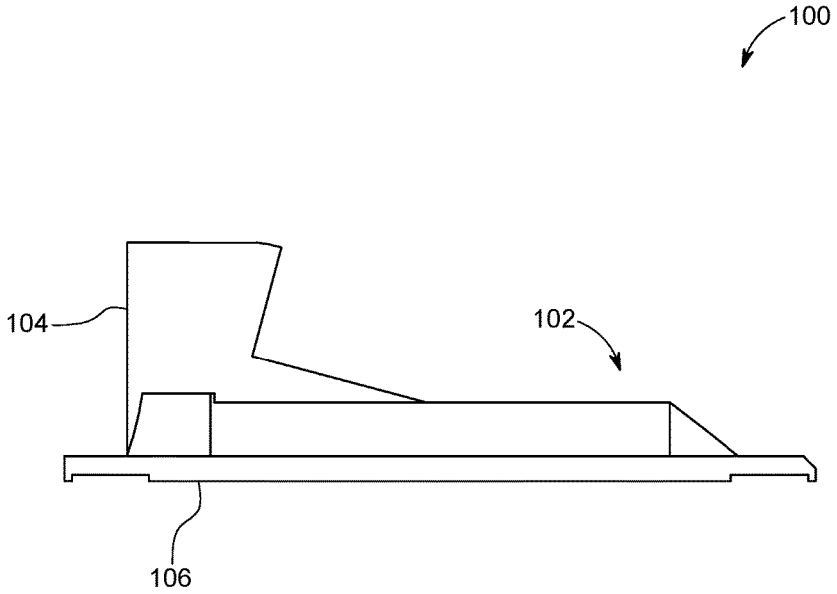
FIG. 5 is a left-side view of a scoop holder according to one embodiment of the present invention.

Referring to FIGS. 4-5, side views of the scoop holder 100 are illustrated. Of note, the second engagement member 104 can extend up and above the first engagement member 102. In some embodiments, as previously mentioned, the second curved surface 114 can be defined by a radius of the second engagement member 104. For instance, the second curved surface 114 can have approximately the same radius of curvature as the outside of the second engagement member 104.

Figure 7:
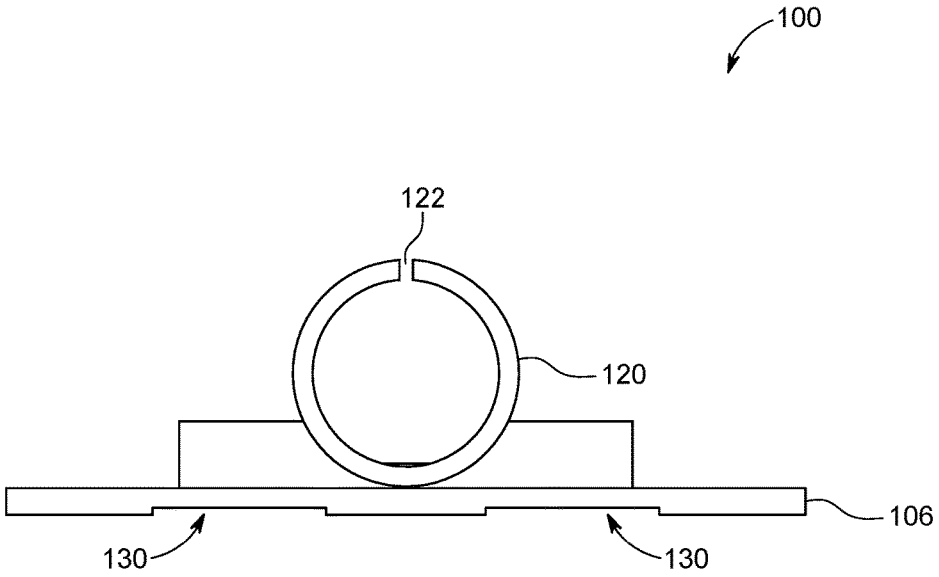
FIG. 7 is a back view of a scoop holder according to one embodiment of the present invention.

Referring to FIG. 7, a back view of the scoop holder 100 is illustrated. As shown, the second slot 122 can extend through a wall from a front to a back of the second engagement member 104. As can be appreciated, the handle of a scoop can pass through the front and out the back of the second engagement member 104 with a portion of the handle passing through the second slot 122. A stiffening rib of the scoop handle can interface with an interior of the second engagement member 104 thus allowing the scoop holder 100 to be inverted when attached to a container lid.

Figure 8:
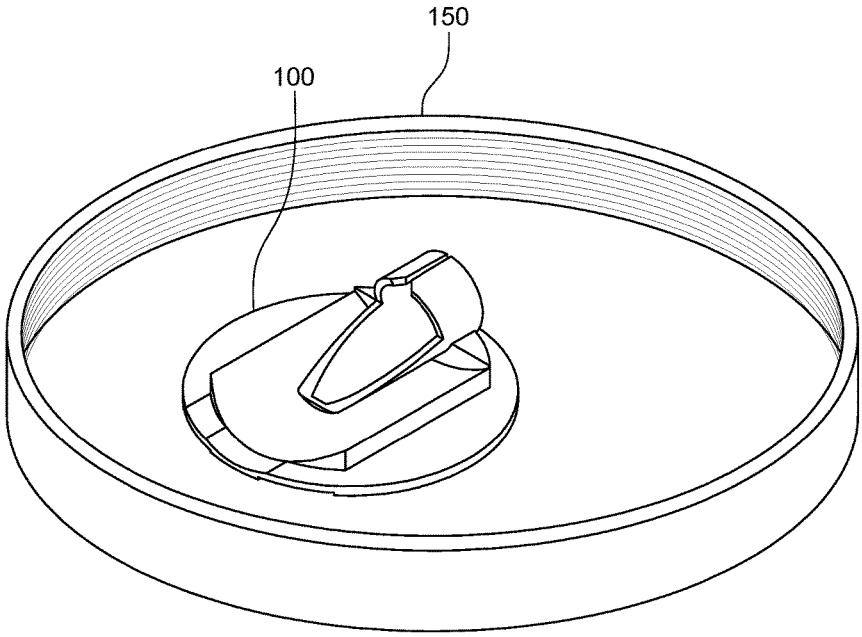
FIG. 8 is a perspective view of a scoop holder coupled to a lid according to one embodiment of the present invention.

Referring to FIG. 8, a detailed diagram of the scoop holder 100 coupled to a lid 150 is illustrated. In a typical implementation, the scoop holder 100 can be coupled to an underside of the lid 150. As can be appreciated, when a scoop is coupled to the scoop holder 100 and the lid 150 is screwed onto a container, the scoop can be stored in an interior of the container. Of note, by having the scoop stored inside the container, space can be saved and the scoop can be kept securely with the container. Further, by suspending the scoop above contents kept in the container, the scoop can remain relatively clean and be readily accessible by a user when they unscrew the lid. As can be appreciated, the scoop holder 100 can be attached to other parts of the container. For instance, the scoop holder could be attached to an exterior of the container or on top of the lid.

Figure 9:
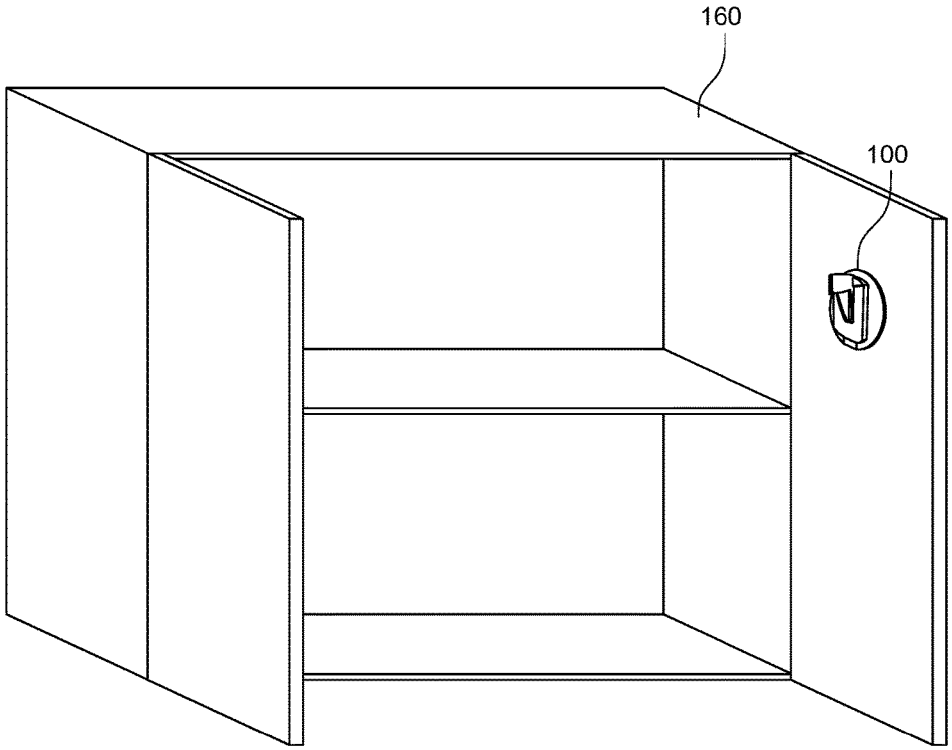
FIG. 9 is a perspective view of a scoop holder coupled to a cabinet door according to one embodiment of the present invention.

Referring to FIG. 9, a detailed diagram of the scoop holder 100 coupled to an interior of a cabinet door 160 is illustrated. In such an embodiment, the scoop holder 100 could be implemented to couple to any utensil having either a bowl or flat handle. Typically, an adhesive can be placed into the recesses 130 on the bottom of the base 106 and then the scoop holder 100 can be coupled to the cabinet door.

Figure 10:
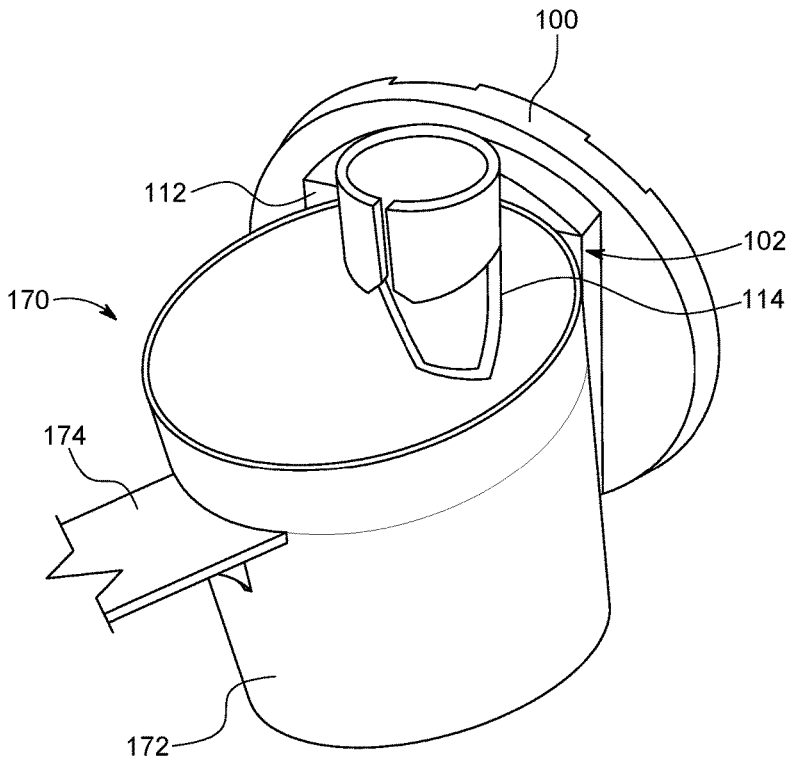
FIG. 10 is a perspective view of a scoop holder coupled to a bowl of a scoop according to one embodiment of the present invention.

Referring to FIG. 10, a detailed diagram of a bowl 172 of a scoop 170 attached to the first engagement member 102 of the scoop holder 100 is illustrated. Of note, the bowl 172 of the scoop 170 can be passed between the first curved surface 112 and the second curved surface 114 of the scoop holder 100. As previously mentioned, the bowl 172 can be snugly received between the two surfaces 112, 114.

Figure 11:
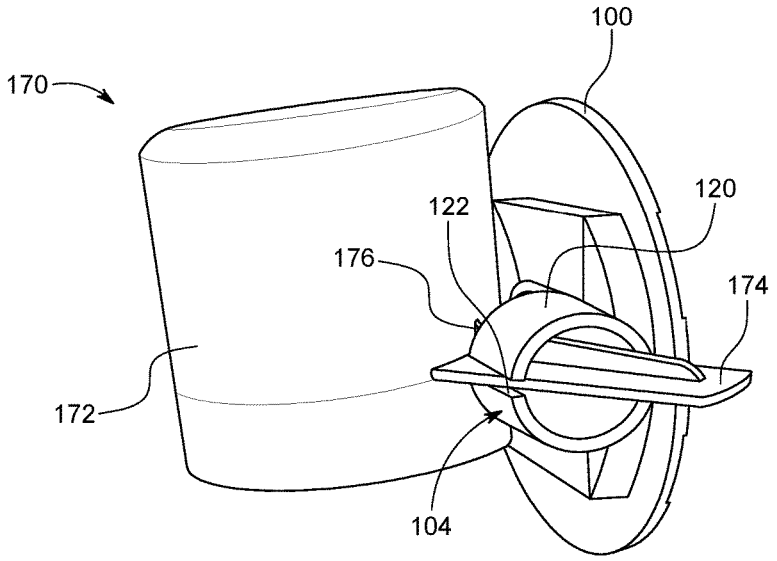
FIG. 11 is a perspective view of a scoop holder coupled to a handle of a scoop according to one embodiment of the present invention.

Referring to FIG. 11, a detailed diagram of a handle 174 of the scoop 170 attached to the second engagement member 104 of the scoop holder 100 is illustrated. As shown, a portion of the handle 174 of the scoop 170 can pass through the hollow cylinder 120 and the second slot 122 to secure the handle 174 to the scoop holder 100. Of note, most scoop handles include a stiffening rib 176 to provide rigidity to the handle. As shown in FIG. 11, the stiffening rib 176 can help secure the scoop 170 to the second slot 122 of the scoop holder 100. For instance, the stiffening rib 176 can interface with an interior of the hollow cylinder 120 to more securely hold the scoop 170 when the scoop holder 100 may be inverted. For example, if the scoop holder 100 were attached to an underside of a lid of a container, the scoop holder 100 would be upside down when the lid was secured to the container. As such, the stiffening rib 176 may help to keep the scoop secured to the scoop holder 100 by interfacing with the interior of the hollow cylinder 120.

A Second Embodiment of a Scoop Holder

Figure 12:
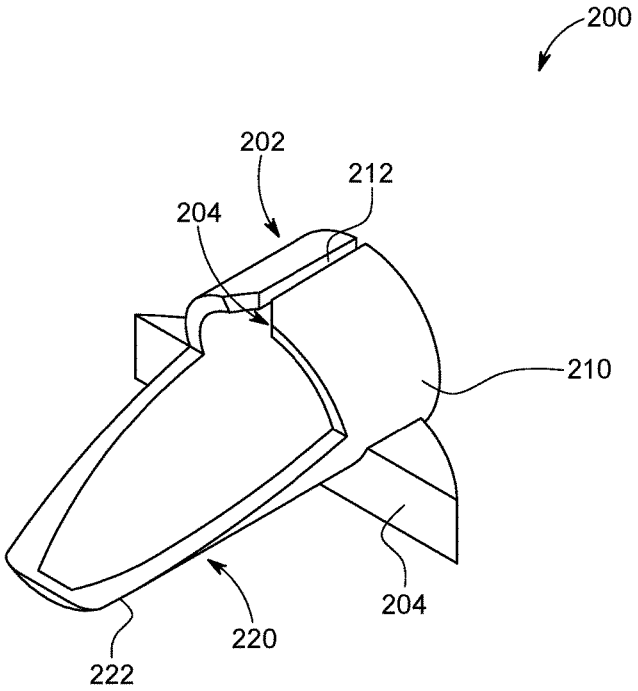
FIG. 12 is a perspective view of a scoop holder according to one embodiment of the present invention.

Referring generally to FIG. 12, a detailed diagram of a second embodiment 200 of a scoop holder is illustrated. The second embodiment scoop holder 200 can include components similar to the components of the first embodiment scoop holder 100.

As shown in FIG. 12, the second embodiment scoop holder 200 can include components substantially similar to the second engagement member 104 of the first embodiment scoop holder 100. The second embodiment scoop holder 200 can include, but is not limited to, a hollow cylinder 202 and an attachment member 204. The hollow cylinder 202 can typically be integrally formed with the attachment member 204. The attachment member 204 can be implemented to create an open space (or gap) between a bottom of the hollow cylinder 202 and a surface the attachment member 204 is coupled to or integrally formed therewith. The hollow cylinder 202 can be defined by a radius of curvature $r_3$ (not shown) similar to the second curved surface 114 and the hollow cylinder 120 being defined by the second radius of curvature $r_2$.

In one embodiment, an adhesive can be implemented on a bottom of the attachment member 204 to secure the scoop holder 200 to a surface. As can be appreciated, other types of means for securing the attachment member 204 to a surface are contemplated. In one embodiment, the scoop holder 200 may be integrally formed as part of another component. For instance, the scoop holder 200 may be co-molded as part of a lid or container. Of note, one embodiment of the attachment member 204 is shown for illustrative purposes only. Other configurations and shapes are contemplated for the attachment member 204 and the illustrated version is not meant to be limiting. In some embodiments, a bottom of the attachment member 204 can include recesses similar to the first embodiment recesses 130 for placement of an adhesive or other fastener to mate the attachment member 204 flush to a surface.

The hollow cylinder 202 can include a first portion 210 and a second portion 220. The first portion 210 can be the substantially hollow cylinder 202 including a slot 212 that bisects a wall of the hollow cylinder 202. The slot 212 can typically be located at an apex of the hollow cylinder 202. In one embodiment, the slot 212 can include a mouth 214 proximate a front of the slot 212 to help receive a handle of a scoop, similar to the mouth 124 of the first embodiment scoop holder 100. The attachment member 204 can extend down from a bottom of the first portion 210 to provide a gap between the second portion 220 and a surface and to couple the scoop holder 200 to another surface.

The second portion 220 of the hollow cylinder 202 can be defined by a substantial portion of the hollow cylinder 202 being removed (e.g., cut out) leaving an elongated section extending away from the first portion 210 of the hollow cylinder 202. The second portion 220 can include a curved surface 222 defined by the radius of curvature $r_3$ of the hollow cylinder 202. The curved surface 222 can be configured to oppose a surface the scoop holder 200 is attached to forming a slot between the curved surface 222 and a surface the scoop holder is attached to.

In a typical implementation, the second embodiment scoop holder 200 can be attached to a surface with the attachment member 204 coupling to the surface. For instance, the attachment member 204 can secure the scoop holder 200 to an underside of a lid of a container. A scoop can then be attached via either a handle of the scoop or a bowl of the scoop to the scoop holder. Similar to the first embodiment scoop holder, the slot 212 of the scoop holder 200 can be configured to receive and secure a handle thereto. A slot formed between the surface and the second portion 220 of the scoop holder 200 can be configured to receive the bowl of the scoop. As can be appreciated, the scoop holder 200 can be configured to secure the scoop by either the bowl or the handle, depending on a particular implementation.

ALTERNATIVE EMBODIMENTS AND VARIATIONS

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

We claim:

1. A scoop holder comprising:
- a base;
- a first protrusion extending upwardly from the base, the first protrusion being defined by a substantially curved upper surface being concave;
- a second protrusion extending upwardly from the base and above the first protrusion, the second protrusion being defined by:
  - a first portion, the first portion having a curved bottom surface and opposing the first protrusion; and
  - a second portion, the second portion being a hollow cylinder having a slot that bisects a wall of the hollow cylinder.

2. The scoop holder of claim 1, wherein the first protrusion and the first portion of the second protrusion are adapted to receive a bowl of a scoop.

3. The scoop holder of claim 1, wherein the slot of the second portion of the second protrusion is adapted to receive a handle of a scoop.

4. The scoop holder of claim 1, wherein (i) the curved upper surface is defined by a first radius of curvature, (ii) the curved bottom surface is defined by a second radius of curvature, and (iii) the first radius of curvature is larger than the second radius of curvature.

5. The scoop holder of claim 1, wherein the slot of the second portion includes a mouth.

6. The scoop holder of claim 1, wherein the base includes at least one recess located on a bottom of the base.

7. The scoop holder of claim 1, wherein the slot of the second portion is located at an apex of the hollow cylinder.

8. A scoop holder comprising
- a first engagement member adapted to secure a bowl of a scoop, the first engagement member being defined by:
  - a first curved surface being substantially concave;
  - a second curved surface opposing the first curved surface, the second curved surface being substantially convex;
  - wherein the first curved surface and the second curved surface form a first slot;
- a second engagement member adapted to secure a handle of a scoop, the second engagement member being defined by:

a cylindrical ring having a second slot that bisects a wall of the cylindrical ring;

a base coupled to at least the first engagement member.

9. The scoop holder of claim 8, wherein the second engagement member is coupled to the first engagement member.

10. The scoop holder of claim 8, wherein (i) the first curved surface is defined by a first radius of curvature, (ii) the second curved surface is defined by a second radius of curvature, and (iii) the first radius of curvature is larger than the second radius of curvature.

11. The scoop holder of claim 10, wherein the second radius of curvature is approximately equal to a radius of the cylindrical ring.

12. The scoop holder of claim 8, wherein the second slot includes a mouth.

13. The scoop holder of claim 8, wherein the second engagement member is coupled to the base.

14. A scoop holder comprising:

a first slot adapted to receive a bowl of a scoop, the first slot including:

a first curved surface being (i) concave, and (ii) defined by a first radius of curvature;

a second curved surface being (i) convex, (ii) located above and opposing the first curved surface, and (iii) defined by a second radius of curvature;

wherein the first radius of curvature is larger than the second radius of curvature;

a second slot adapted to receive a handle of the scoop, the second slot bisecting a wall of a hollow cylinder.

15. The scoop holder of claim 14, wherein the bowl of the scoop is adapted to be snugly received by the first slot.

16. The scoop holder of claim 14, wherein the first curved surface is integrally formed with the second curved surface and the hollow cylinder.

17. The scoop holder of claim 14, wherein the second curved surface is integrally formed with the hollow cylinder.

18. The scoop holder of claim 17, wherein the second radius of curvature is approximately equal to a radius of the hollow cylinder.

19. The scoop holder of claim 14, wherein a front of the second slot includes a mouth.

20. The scoop holder of claim 14 in combination with a lid.

* * * * *